US008322381B1

(12) United States Patent
Glanville et al.

(10) Patent No.: US 8,322,381 B1
(45) Date of Patent: Dec. 4, 2012

(54) STATIC FLUID FLOW CONDITIONER

(76) Inventors: Robert W Glanville, Bristol, RI (US); Kimbal A. Hall, Holden, MA (US)

( * ) Notice: Subject to any disclaimer, the term of this patent is extended or adjusted under 35 U.S.C. 154(b) by 284 days.

(21) Appl. No.: 12/924,956

(22) Filed: Oct. 8, 2010

Related U.S. Application Data

(60) Provisional application No. 61/278,763, filed on Oct. 9, 2009.

(51) Int. Cl.
*F15D 1/02* (2006.01)
*B01F 5/00* (2006.01)

(52) U.S. Cl. ..... 138/39; 138/37; 138/44; 138/42; 366/337; 366/338

(58) Field of Classification Search ..... 138/39, 138/37, 42, 44; 366/337, 338, 340
See application file for complete search history.

(56) References Cited

U.S. PATENT DOCUMENTS

| | | | | |
|---|---|---|---|---|
| 1,706,145 | A * | 3/1929 | Collins | 138/40 |
| 1,741,019 | A * | 12/1929 | Harrington | 198/658 |
| 3,636,983 | A * | 1/1972 | Keyser | 138/39 |
| 4,600,544 | A * | 7/1986 | Mix | 261/79.2 |
| 4,869,594 | A * | 9/1989 | Mahoney, Jr. | 366/341 |
| 6,000,841 | A * | 12/1999 | Cooke et al. | 366/337 |
| 6,056,014 | A * | 5/2000 | Kojima et al. | 138/39 |
| 6,152,592 | A * | 11/2000 | Klein | 366/80 |
| 6,155,706 | A * | 12/2000 | Klein | 366/80 |
| 6,474,364 | B2 * | 11/2002 | Ta et al. | 138/37 |
| 7,753,080 | B2 * | 7/2010 | Liu et al. | 138/39 |
| 8,147,124 | B1 * | 4/2012 | Glanville | 366/338 |
| 2002/0031046 | A1 * | 3/2002 | Schneider et al. | 366/181.5 |
| 2003/0072214 | A1 * | 4/2003 | Fleischli et al. | 366/175.2 |

* cited by examiner

*Primary Examiner* — Parick F Brinson
(74) *Attorney, Agent, or Firm* — Robert J Doherty

(57) ABSTRACT

A static conditioner for mounting within a tubular conduit in turn supporting fluid flow therein and including a two-stage construction having a first stage including primary vanes including laterally extending caps radially inwardly extending into the fluid flow so as to separate and direct flow against the conduit walls and a second stage of secondary plates positioned immediately downstream of the first stage and laterally offset therefrom so as to eliminate swirl and turbulence remaining in the flow after the first stage.

7 Claims, 10 Drawing Sheets

1000-cfm air flow in a 6-in Sch40. steel pipe, after two out-of-plane 90° bends.

1000-cfm air flow in a 6-in Sch40. steel pipe, after two out-of-plane 90° bends.
The flow conditioner is installed 4D downstream of the second bend.

1000-cfm air flow in a 6-in Sch40. steel pipe, after two out-of-plane 90° bends.
The flow conditioner is installed either 0D or 4D downstream of the second bend.

1000-cfm air flow in a 6-in Sch40. steel pipe, after two out-of-plane 90° bends.
The flow conditioner is installed either 4D downstream of the second bend.

STATIC FLUID FLOW CONDITIONER

Applicant claims the benefit of U.S. Provisional Patent Application Ser. No. 61/278,763 filed Oct. 9, 2009.

BACKGROUND OF THE INVENTION

This invention is directed to a flow conditioner utilized to reduce flow meter measurement errors in a tubular conduit in which a fluid flow including liquids, gases and mixtures thereof is contained. Swirl, turbulence or poor flow distribution or a combination thereof often occur in fluids flowing through a tubular pipe especially after two out-of-plane 90° bends and these undesirable conditions make it difficult to obtain reliable flow measurement, i.e., by the placement of a venturi device flow meter in the conduit. This undesirable condition has led to the use of flow conditioners placed downstream of the conduit portion causing maldistribution, etc. and upstream of the measuring device.

An effective commercially available mixer that also serves to condition flow is described in applicant's previous U.S. Pat. No. 5,839,828 issued Nov. 24, 1998 to Robert W. Glanville. The device disclosed in such patent operates in part by creating trailing vortices which contribute to better flow distribution. The teachings of U.S. Pat. No. 5,839,828 are hereby incorporated into the present specification by specific reference thereto.

It would be desirable to reduce/eliminate the above undesirable flow conditions by providing a flow conditioner which is simple, effective and low cost and that provides such results with an extremely low pressure head loss. This and other objects of the present invention are accomplished by a flow conditioning device positioned in said conduit and within a fluid stream having a longitudinal flow direction with said passageway, said device including a first stage and a second stage wherein said second stage is positioned immediately downstream of said first stage, said first stage comprising a plurality of primary vane members forming a set thereof, said vanes spaced generally circumferentially equidistantly within said conduit and radially inwardly extending from said conduit internal wall surface towards the center of said conduit, each of said primary vane members including a generally oblong plate of planar extent with a generally straight base edge attached to said internal conduit wall and further including a leading edge upstanding from a base edge forward portion to a peak from which, in turn, a rearwardly downwardly curved trailing edge extends and terminates proximal the rear portion of said base edge, each of said plates including a generally triangularly-shaped cap attached and conforming to said curved trailing edge thereof with the cap apex aligned with said leading edge peak so as to form cap undersurfaces and cap top surfaces and said second stage comprising a plurality of secondary vanes each having a secondary plate member including a base edge surface disposed against the conduit surface at an offset position vis-à-vis the positions of said primary vanes, said secondary plates radially inwardly extending into the fluid stream and, said secondary plates including a flat wing member extending laterally therefrom.

Other objects, features and advantages of the invention shall become apparent as the description thereof proceeds when considered in connection with the accompanying illustrative drawings.

DESCRIPTION OF THE DRAWINGS

In the drawings that illustrate the best mode presently contemplated for carrying out the present invention.

DESCRIPTION OF THE INVENTION

Figure 1:
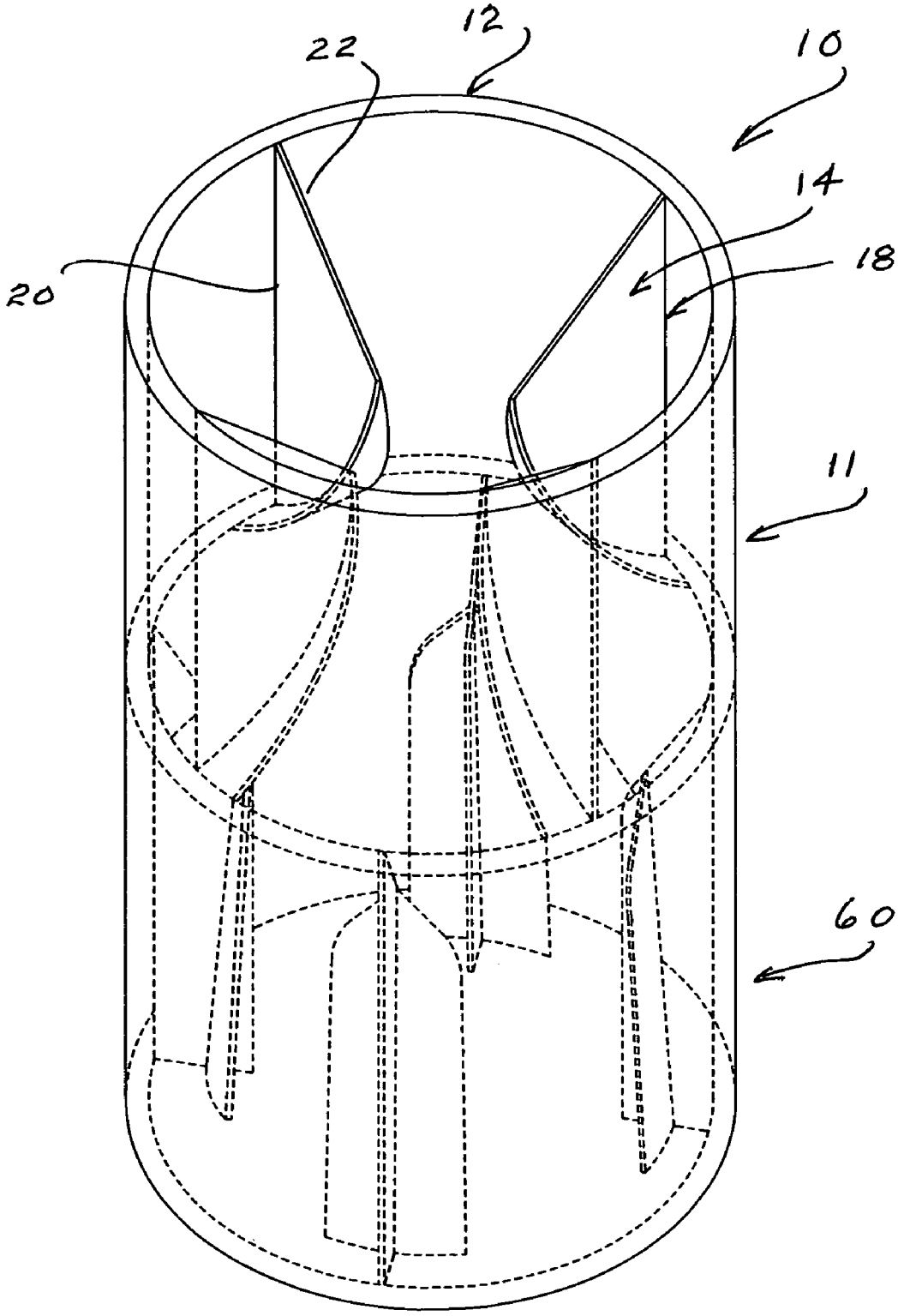
FIG. 1 is a perspective view of the flow-conditioning device of the present invention mounted within a pipe section.
Figure 1A:
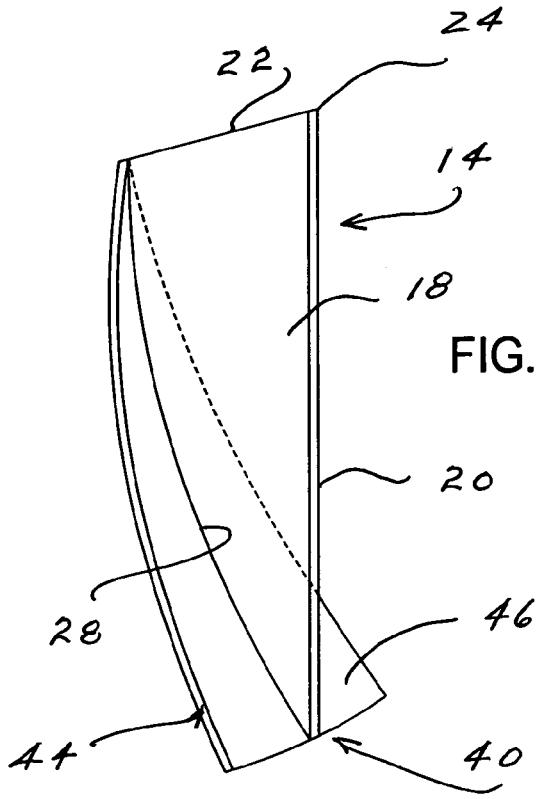
FIG. 1A is a perspective view of one of the individual conditioning vanes that are internally disposed within the pipe section shown in FIG. 1 in the first stage thereof.
Figure 1B:
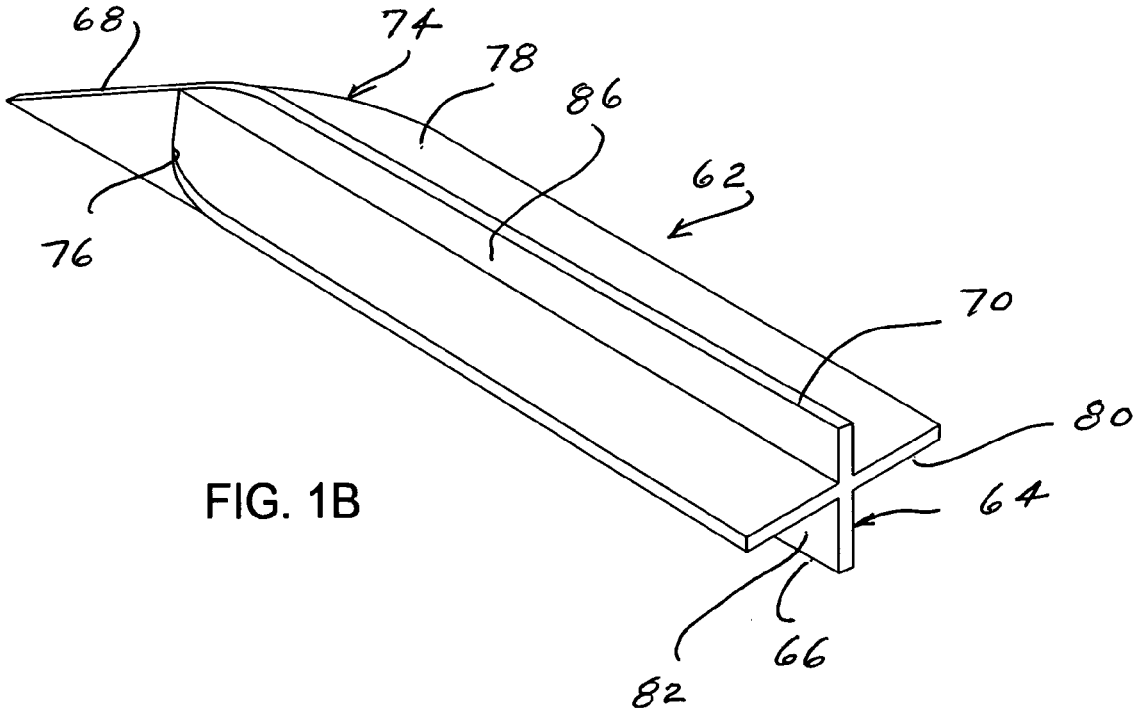
FIG. 1B is a perspective view of one of the winged anti-swirl plates positioned downstream of the first stage of the conditioning vanes.
Figure 2:
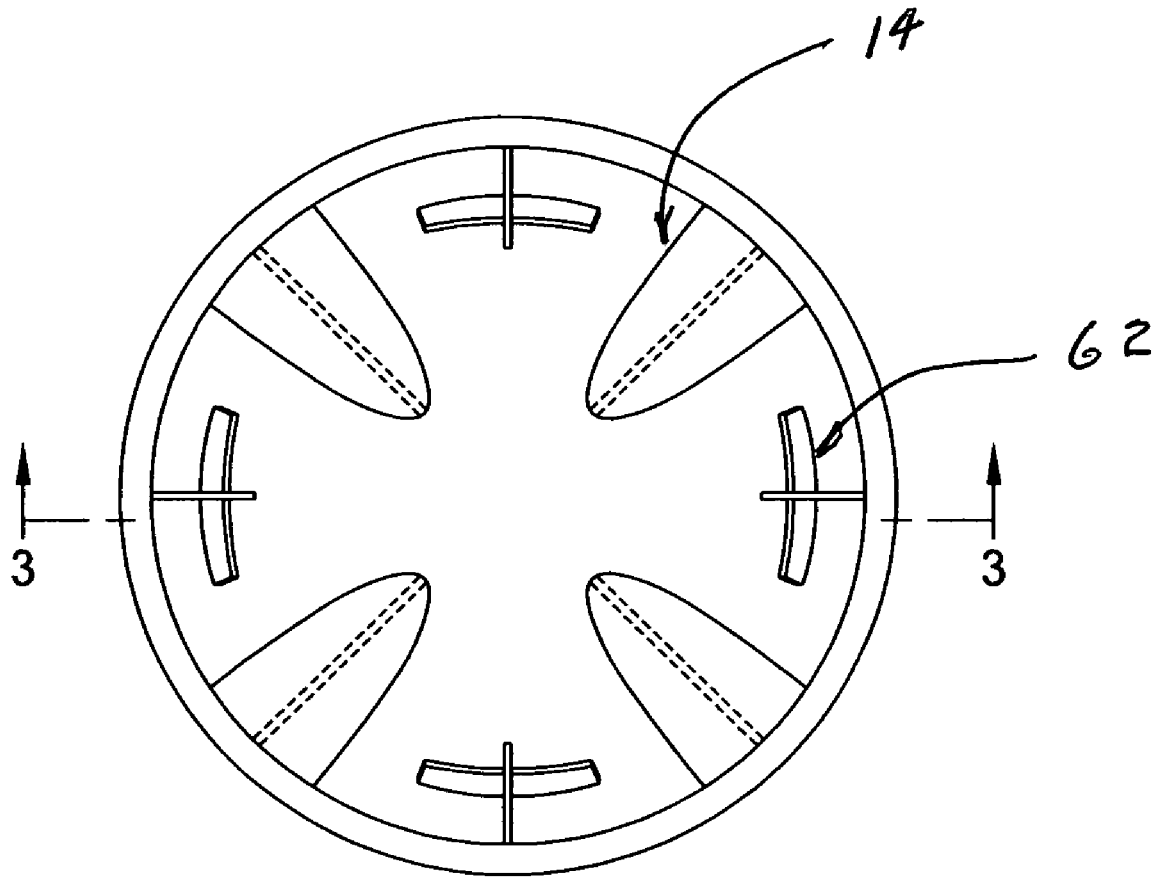
FIG. 2 is a top plan view of FIG. 1.
Figure 3:
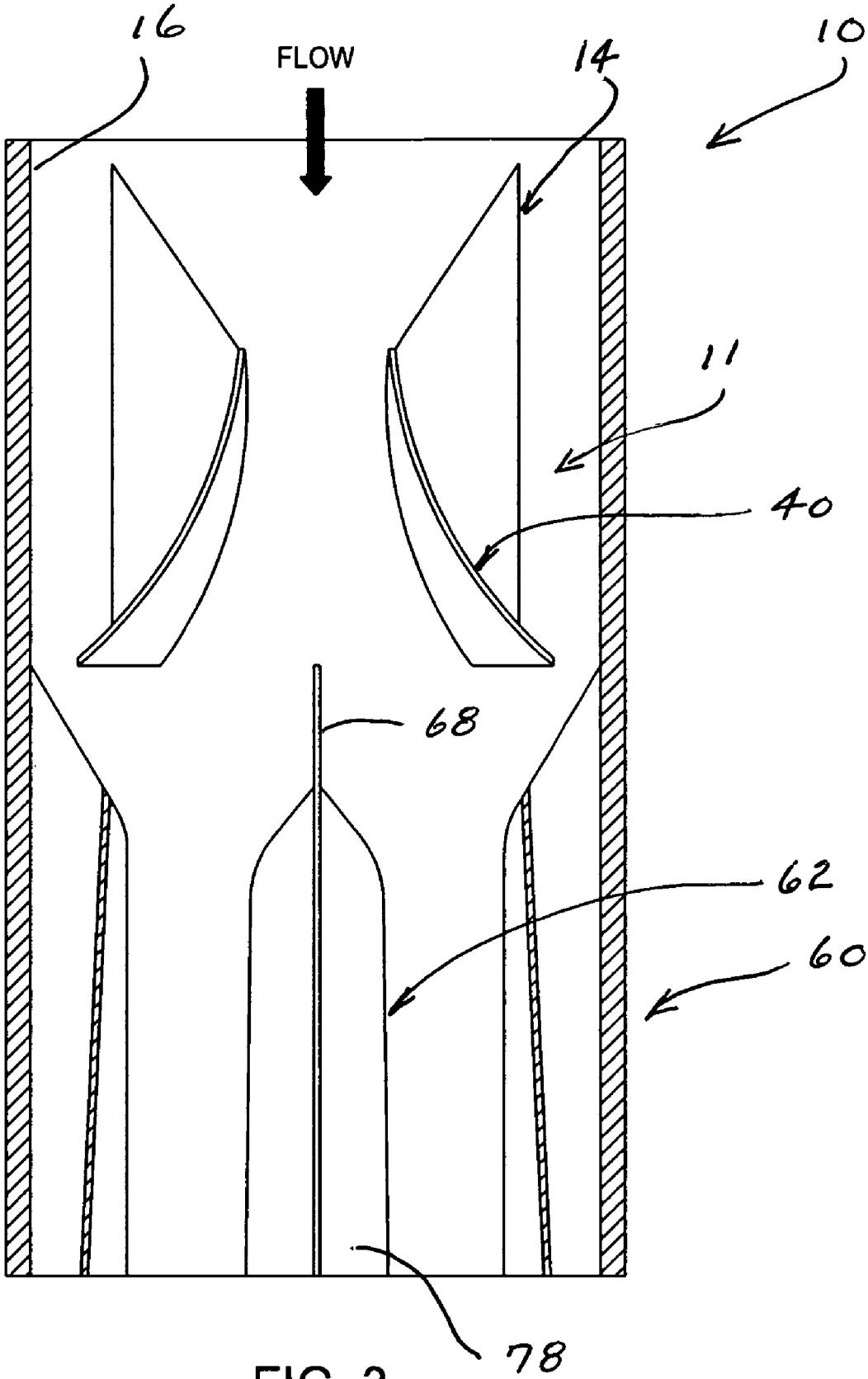
FIG. 3 is a sectional view along the line 3-3 of FIG. 2.
Figure 4:
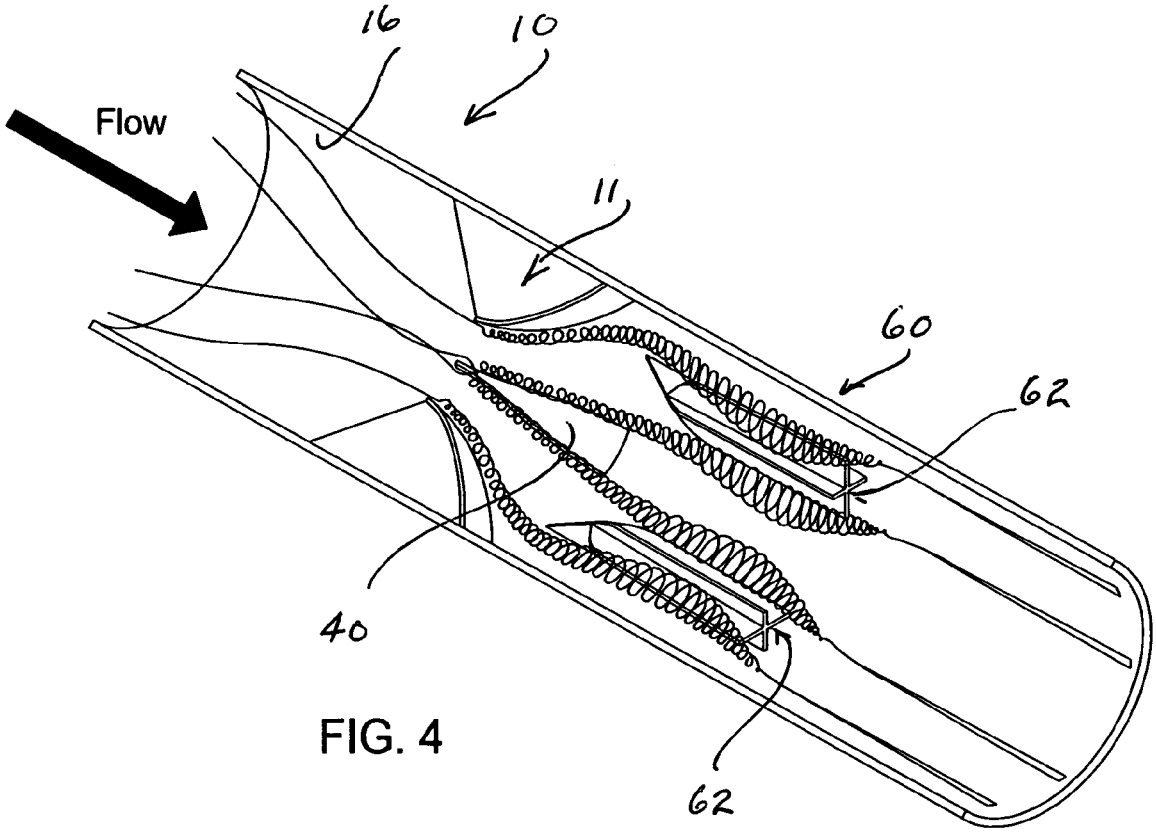
FIG. 4 is a sectional perspective view of the device mounted within a section of pipe and depicting how the trailing vortices are smoothed by the anti-swirl plates.

Turning now to the drawings and particularly FIGS. 1, 1A and 1B, the construction of the conditioning device 10 of the present invention is shown mounted within a pipe section 12 that for fabricating convenience and assembly is subsequently mounted within a longer pipe section in which the fluid to be conditioned is flowing. Obviously, the device could alternatively be mounted directly within the longer pipe section. It should be pointed out that mixing, blending of materials introduced to the flow may be carried out simultaneously with conditioning.

The device 10 includes a first stage 11 comprising a plurality of vanes 14 (generally four vanes) spaced equidistantly within the pipe section and extending from the inner pipe section surface wall 16 radially inwardly extending approximately two thirds of the pipe diameter—thus, larger pipes would have larger mixers and vice-versa. The primary vanes 14 each include a primary plate member 18 of planer extent with a straight base edge 20 which, in turn, is welded, glued or otherwise attached to the inner pipe wall surface 16 depending on the type material from which the mixer and the pipe in which the mixer is mounted is constructed, e.g., metal such as stainless steel or plastic such as PVC with or without a Teflon coating. The plate members 18 are shaped to resemble an upstanding oblong tab with a leading edge wall 22 extending upwardly and rearwardly from the forward edge 24 of the base edge 20 at an angle of approximately 45° to a plate peak 26 and connecting with a trailing wall 28 that is curved and extends downwardly rearwardly to the rear edge 30 of the base edge 20 so as to complete the shape of each of the plates 18.

Each tab or primary plate member 18 includes a cap 40 attached to the curved trailing edge 28 of the tab. Each cap 40 is generally triangular in shape, that is, the cap has a narrow, i.e., pointed, front and widening wings extending therefrom. The cap could also be somewhat rounded at the front end thereof and such configuration is encompassed by the term "generally triangular". Each cap includes a cap peak 42 from which side edge walls 44 outwardly rearwardly extend and form inner and outer surfaces 46 and 48 respectively. Generally, the caps 40 are fabricated in the flat and then bent to assume the curve shown in the drawings and attached by appropriate welding or gluing techniques to the trailing wall 28 of the plate. Alternatively, each entire plate member could be injection molded in the case of engineered plastics or forged, etc. when utilizing metals.

The above described combination of plate and cap configuration provides a system where fluid flowing within the pipe system initially encounters the plate forward edge so as to be divided into eight (assuming four vanes) streams and thence each of such streams contacts the separate inner wall surfaces 46 of each of the caps 40 and are forced downwardly outwardly into the inner pipe wall surfaces adjacent the trailing end of the mixer. This action, in effect, turns these individual flow streams inside out and dissipates considerable energy from the flow. In addition, contact of the central stream undivided by the forward edges of the vanes creates trailing vortices that provide a mixing action but such vortices need to be conditioned to lower swirl and turbulence therein.

The primary radial vanes are very effective at eliminating swirl near the pipe walls where the angular momentum is highest. The edges of each of the primary vanes generate two strong counter-rotating vortices that rapidly exchange momentum between the flow at the center of the pipe and at the wall. The angle of the vanes and the vortex pair's close proximity cause the vortices to quickly migrate to the wall where they rapidly decrease in intensity due to high shear stress. Rotational momentum is lost and excessive turbulence is dissipated.

A second stage 60 of secondary vanes 62 are provided immediately downstream of the first stage in order to reduce/remove swirl and eliminate the trailing vortices produced by the first stage. Such vanes 62 include a secondary plate member 64 having a base-edge surface 66 adapted for mounting to the conduit wall such that a plurality of such secondary vanes 62 radially inwardly extend into the fluid stream adjacent the first stage vanes 12 and offset 45° therefrom (assuming four primary vanes 12 and four secondary vanes 62 although other vane set quantities could be utilized.

The secondary plates include a leading slanted edge portion 68 that continues rearwardly to a straight upper wall edge 70. A flat wing member 74 having slanted leading edges 76 is attached to the secondary plates 64 and exhibits flat upper and lower surfaces 78 and 80 respectively which provide contact with the trailing vortices so as to reduce/eliminate such trailing vortices, and the flat opposed sidewall surfaces 82 of the plate 64 eliminate swirl. It should be noted that the plate 64 preferably has a flat upper extension portion 86 extending radially inwardly above the wing member 74 upper surface 78 as opposed to having the wing member mounted above the plate 64, and this preferred embodiment considerably reduces swirl that would be aggravated by the slight expansion of the wing member upper surfaces. The above-described second stage thus eliminates the trailing vortices and swirl and quickly contributes to the establishment of the desired radially symmetric, fully developed profile.

The objective of a flow conditioner is to reduce flow meter measurement error by eliminating swirl, quickly imposing a fully developed velocity profile within the pipe, and minimizing turbulence regardless of the flow conditions upstream. A successful flow conditioner will accomplish this objective with minimal pressure loss and with the shortest pipe length possible.

When coupled with anti-swirl plates, the leading tab concept of the present invention has been proven to be effective at reducing swirl and improving the flow distribution at short distances downstream of the conditioner. Turbulence levels are also maintained at fairly low levels, which helps improve measurement accuracy. The principle by which the conditioner operates is that the primary tabs create vortices that mix the flow by turning the flow "inside-out" and then the vortices quickly dissipate at the pipe wall. The secondary tabs then leave a fully developed, non-swirling flow in their wake.

The model geometry was developed using the commercially available three-dimensional CAD and mesh generation software, GAMBIT V2.4.6. The computational domain generated for the model consisted of approximately 2 million hexahedral and tetrahedral cells.

Numerical simulations were performed using the CFD software package FLUENT V6.3.26, a state-of-the-art, finite volume-based fluid flow simulation package including program modules for boundary condition specification, problem setup, and solution phases of a flow analysis. Advanced turbulence modeling techniques, improved solution convergence rates and special techniques for simulating species transport makes FLUENT particularly well suited for this study.

FLUENT was utilized to calculate the three-dimensional, incompressible, turbulent flow through the pipe and around the flow conditioner. A stochastic, anisotropic, two-equation k-e model was used to simulate the turbulence. The anisotropic model was required to properly resolve the secondary flows that developed as a result of geometry changes. Detailed descriptions of the physical models employed in each of the Fluent modules are available from Fluent, Inc., the developer of Fluent V6.3.26.

The tests were conducted in 6" sch. 40 steel pipe, and the test section consisted of two 90° bends in perpendicular planes separated by 2-pipe diameters (2D). This configuration provides both non-uniform velocity profiles and swirling flow. As noted by the ASME *Measurement of Fluid Flow in Pipes Using Orifice, Nozzle and Venturi* guidelines: "This is not a good upstream installation; a flow conditioner should be used where possible".

The upstream end of the flow conditioner was placed 4-pipe diameters (4D) downstream from the second bend and is used as the datum for comparison. It has been determined through previous testing that the flow conditioner performs similarly at different flow rates provided the flow is turbulent; therefore, only one airflow rate was tested, that is, 1000-cfm at ambient pressure and temperature. A uniform velocity inlet was imposed at the model inlet, which was placed 10-pipe diameters upstream of the first bend. A uniform static pressure boundary condition was imposed at the model outlet that was placed 20-pipe diameters downstream of the mixing device's leading edge such that the impact of the flow conditioner could be documented as a function of downstream distance. On all surfaces, no-slip impermeable adiabatic wall boundary conditions were applied with roughness heights set to 0.00015-ft as appropriate for steel pipe.

A baseline case was evaluated at the tested flow rate without a flow conditioner to compare pressure loss, deviation from fully developed flow profile, swirl, and turbulence.

A fully developed velocity profile was estimated using the empirical power-law equation:

$$\frac{v}{v_{max}} = \left(\frac{y}{R}\right)^{\frac{1}{n}} \text{ where: } n = -1.7 + 1.8 \log Re_u$$

Deviation from fully developed flow was determined by the coefficient of variance (Co V) of the velocity in each cell from the ideal fully developed profile. The power-law equation is only an approximation of a fully developed flow profile and was found to deviate from an actual fully developed profile by approximately 0.89%.

The goal of the flow conditioner is to develop a fully developed profile quickly. To achieve this profile quickly, swirl needs to be eliminated, and a fully developed profile needs to be established where the velocity and turbulence profiles no longer change as the fluid travels downstream.

Flow Characteristics:

The basic beneficial flow characteristics that the leading tab flow conditioner creates are:

- Two strong counter rotating vortices that are generated at the edges of the primary tabs in the bulk flow (away from the wall). These vortices very quickly exchange momentum between the flow at the center of the pipe and the flow at the wall.
- The vortices quickly migrate to the wall in the wake of the primary tabs due to the tab angle and the vortex pair's close proximity to each other. Once attached to the wall, the vortices quickly decrease in intensity due to high shear stress at the pipe wall through which rotational momentum is lost and excessive turbulence is dissipated.
- Radial fins that effectively eliminate swirl near the pipe walls where the rotational inertia is greatest.
- Relatively low-pressure loss associated with this device (0.94 inwg with ambient air at 1000 acfm in a 6"-pipe. or a k-value of 0.57).
- Tapered leading edges and other geometric features that prevent fouling.
- Secondary tabs located downstream of the primary tabs that eliminate the trailing vortices and quickly establish a radially symmetric fully developed velocity profile.

Figure 5:
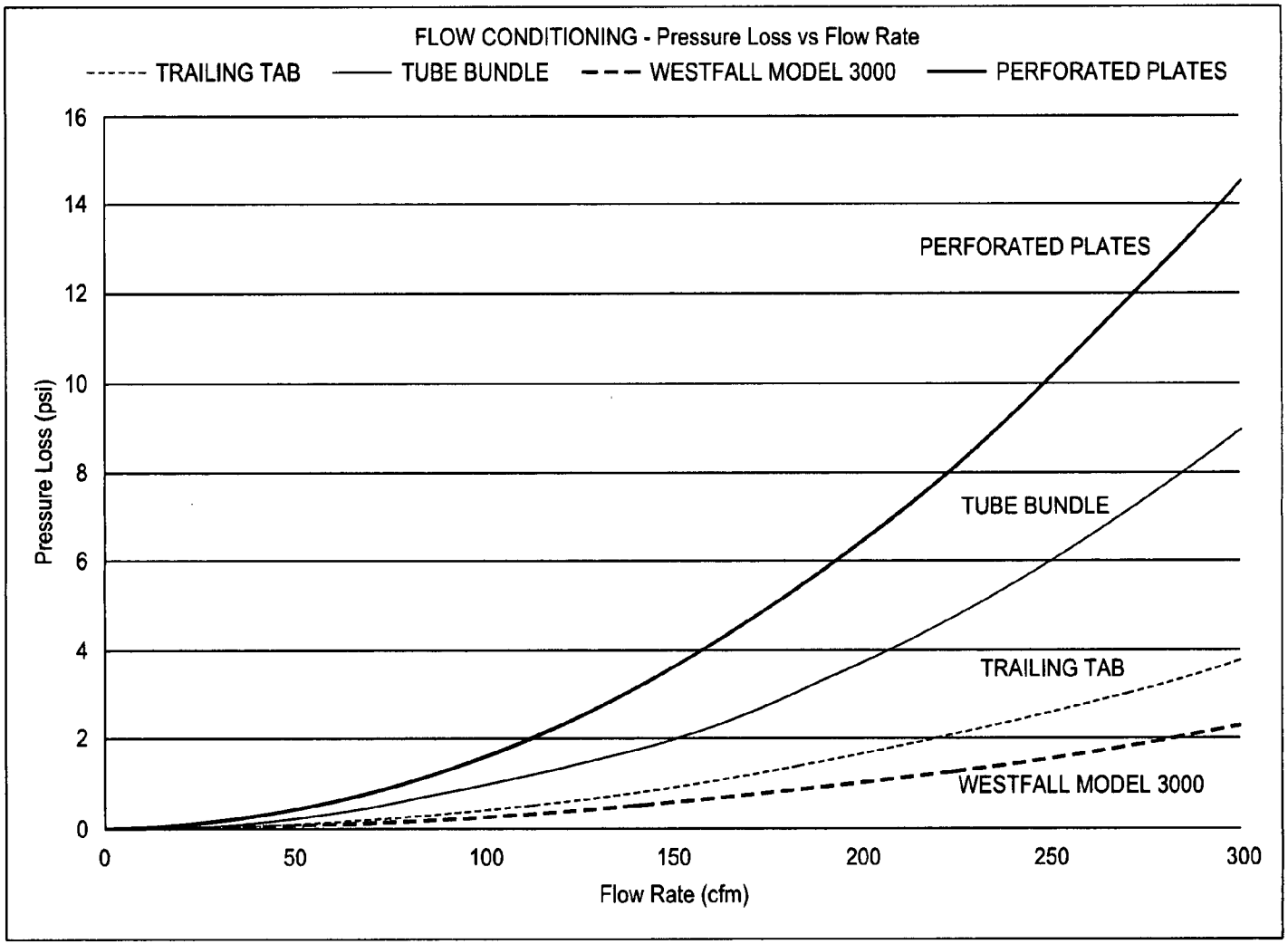
FIG. 5 is a graph depicting the results of CFD analysis and showing the results of flow conditioning effectiveness achieved by the device of the present invention identified as Westfall Model 3000 and three commercially available conditioning devices, namely, the trailing tab conditioner produced by Vortab Co. and identified as Model VIS insertion sleeve flow conditioner, the tube bundle pictured on Page 3 of the 6-page article by Klaus J. Zanker entitled *Gas Flow Conditioning*, and the perforated plate conditioner identified as the CPA 50E flow conditioner and which articles are included in applicant's Document Disclosure.

Pressure Loss:

Pressure loss was measured across the flow conditioner by comparing pressure at the test section inlet with and without the conditioner installed. From the results, a k-value of 0.574 was calculated using the pressure loss and a gas density of 0.076 lbm/ft3: The addition of the secondary tabs increases the pressure loss by 1.6% compared to the conditioner without the secondary tabs. The k-value may be used to extrapolate to find pressure losses at other conditions as long as the flow remains incompressible. A plot of pressure loss vs. flow rate is depicted in FIG. 5.

There are three main sources of measurement error in flow meters, and each will be addressed separately: swirl, flow maldistribution and turbulence.

Swirl:

Swirl can be induced by consecutive out-of-plane bends, as is the case studied, and takes many pipe diameters to die out due to friction. Swirl causes measurement error especially in orifice flow meters by influencing the pressure measured at the pressure taps.

The radial vanes in this flow conditioner are very effective at eliminating swirl near the pipe walls where the angular momentum is highest. A small amount of swirl remains untreated in the center of the flow; however, this swirl represents a very small fraction of the flow energy and should not contribute to significant measurement error.

Figure 6:
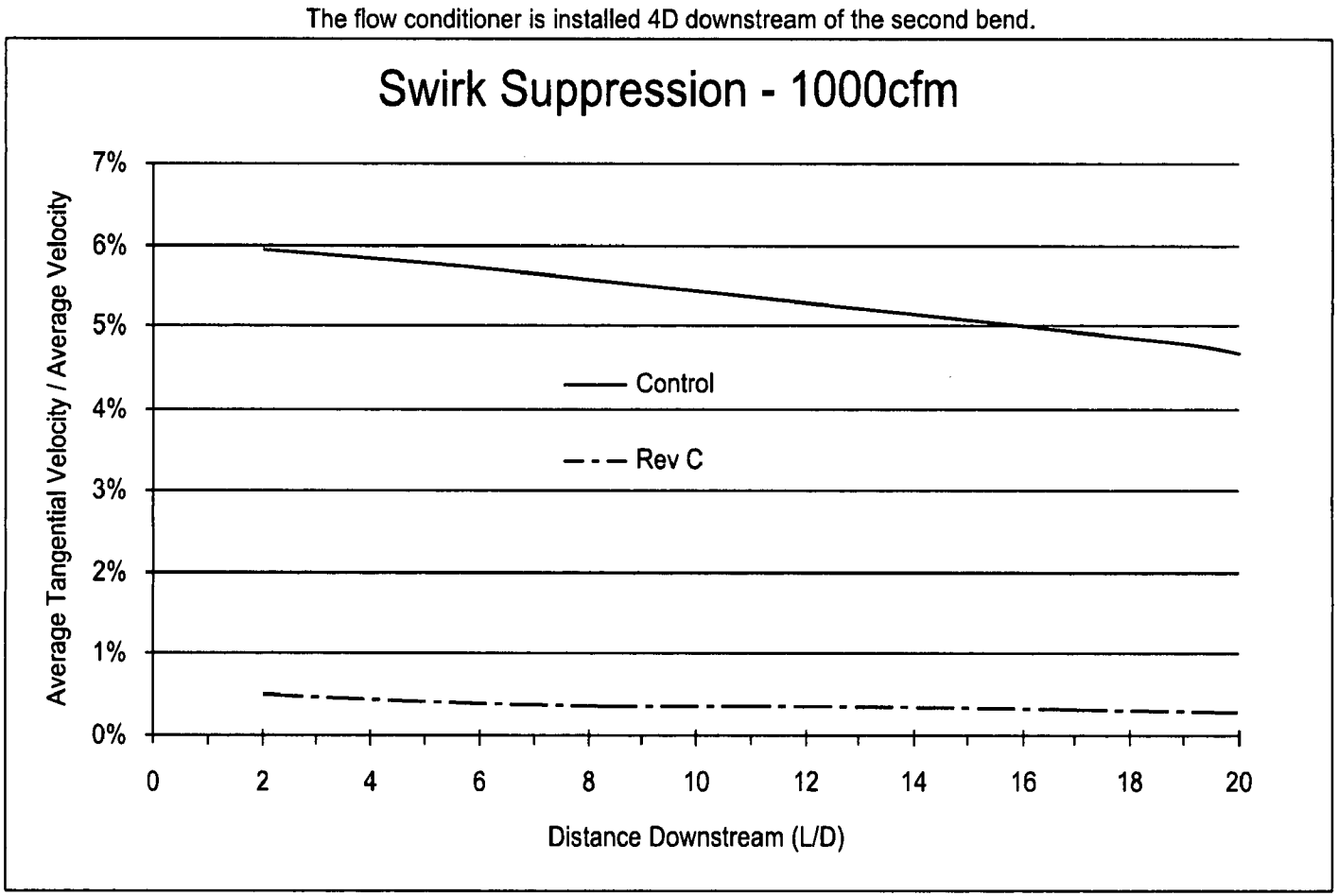
FIG. 6 is a graph showing the swirl decay using the device of the present invention identified as Rev C as compared to a control.

Swirl is measured as the average tangential velocity divided by the average axial velocity. The swirl decay rates remain the same for all flow conditions and will remain the same as long as the flow is turbulent. The swirl with the secondary tabs is similar to the swirl without the secondary tabs at distances of 7D (7-pipe diameters) or greater. The extension of the radial fin above the transverse surface on the secondary tabs was found to considerably reduce swirl that would otherwise be aggravated by the slight expansion of the spanwise surfaces on the secondary tabs. A plot of the decay of swirling flow for the 1000-cfm case is set forth in FIG. 6.

Flow Distribution:

Poor flow distribution naturally occurs after any pipe bend or change in cross section. This causes measurement error in orifice meters as the high and low velocities are not evenly distributed radially such that the pressure measured at the tap is not necessarily an accurate indication of the average pressure at that location.

The leading tab flow conditioner addresses maldistribution by inducing a small amount of pressure loss and turning the flow "inside-out" so that momentum is fully exchanged across the flow stream.

Flow distribution is measured as the CoV of the flow from a fully developed flow profile. Although deviation from fully developed flow is a useful measure of what distance downstream a flow meter can be placed, that distance does not directly translate to a quantifiable level of measurement error. Due to the flow disturbance caused by the flow conditioner, the initial deviation from a fully developed profile is greater with the conditioner than without, but by less than 4D downstream, the conditioner creates a more developed profile. The addition of the secondary tabs to the flow conditioner help to develop a fully developed profile more quickly by completely eliminating the swirl from primary tabs. Additionally, the spanwise surface of the secondary tab is tapered towards the wall to further reduce any momentum transfer from the center to the wall (and vice versa) while providing a diffuser section to reduce the peak centerline velocity to that of a fully developed flow. With these flow features, the velocity profile is essentially fully developed by 8D downstream of the conditioner inlet.

In order to achieve the shortest duct run possible, the flow conditioner was also tested with the flow conditioner placed at the outlet of the second bend. The conditioner was tested with the primary fins oriented at 0° to the axis of the bend and also at 45° to the bend axis. The deviation from fully developed flow was measured as a function of downstream distance from the bend outlet and compared to the results with the inlet to the conditioner placed 4D downstream of the bend outlet.

Figure 7:
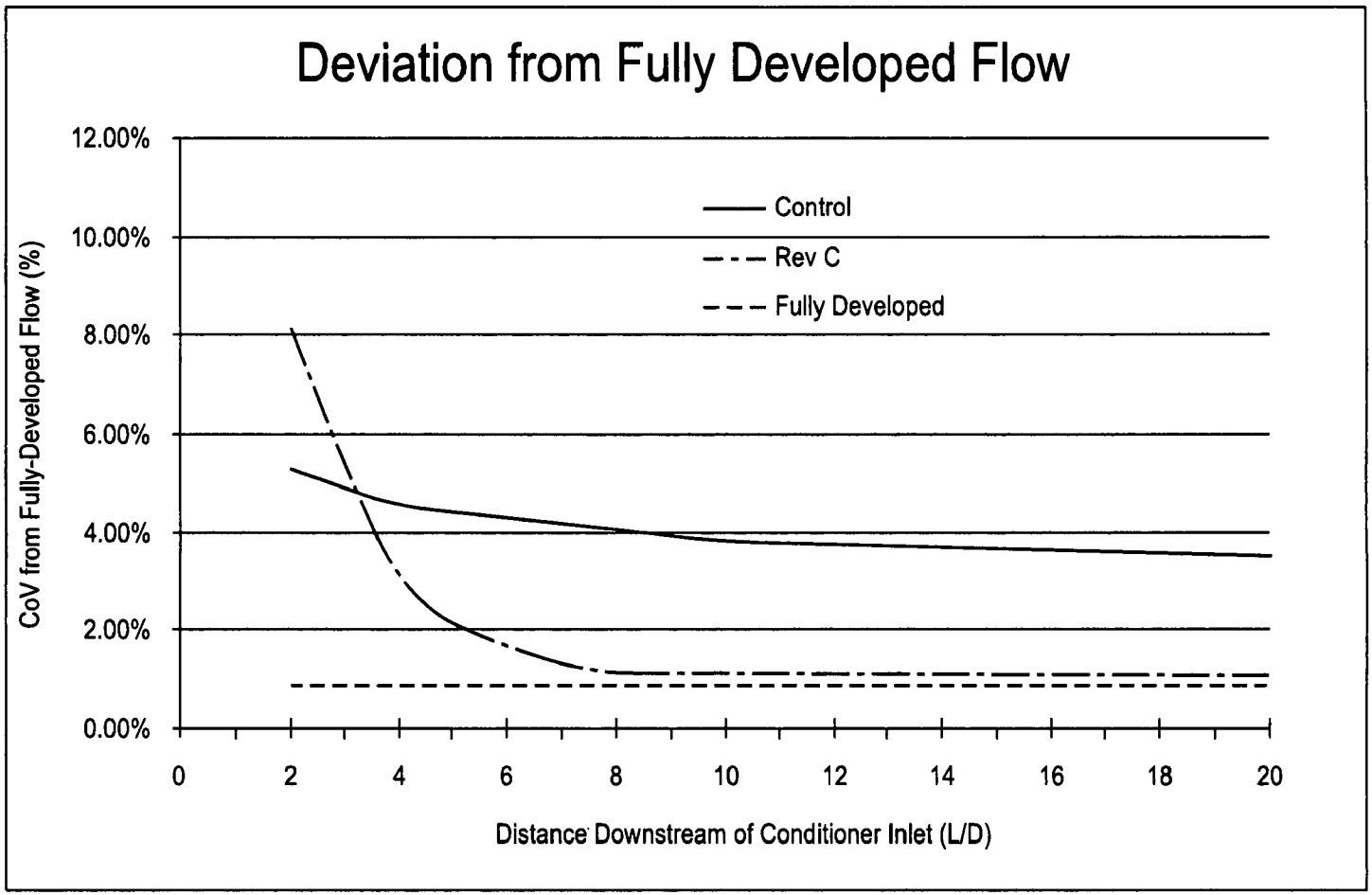
FIG. 7 is a graph showing deviation from fully developed flow distribution for the device of the present invention (Rev C)
Figure 8:
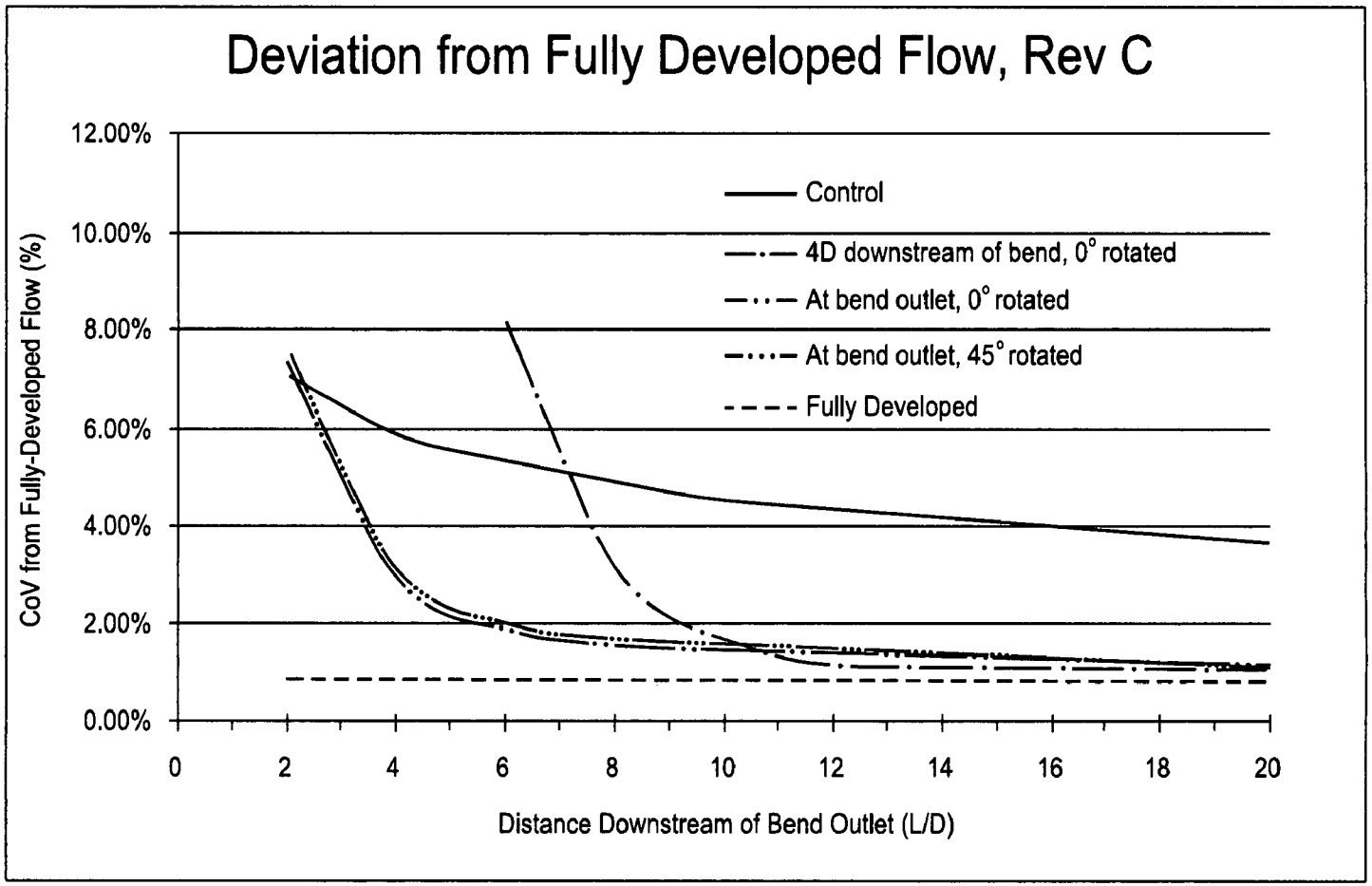
FIG. 8 is a graph showing average turbulent intensity for the device of the present invention (Rev C)

It was found that the flow conditioner's performance is insensitive to orientation since the 0° and 45° orientations had nearly identical flow deviations at all points downstream of the conditioner. It was also found that the flow conditioner performs slightly better 4D downstream of the bend than 0D downstream of the bend, but until the measurement error of the conditioner is tested, it is unknown if this slight difference in flow deviation will result in significant differences in measuring error. In any case, placing the flow conditioner directly at the bend outlet yields a better flow profile within 10D of the bend outlet, and further than 10D downstream the flow conditioner performs better 4D downstream of the bend. A plot of the deviation from fully developed flow for the 1000-cfm case are set forth in FIG. 7 and FIG. 8.

Turbulence:

Excessive levels of turbulence can be a cause for measurement error especially in ultrasonic flow meters. The flow conditioner reduces turbulence downstream much more quickly than a trailing tab or perforated plate flow conditioner by forcing the turbulence to the walls where it dissipates quickly due to the increased shear stress.

Figure 9:
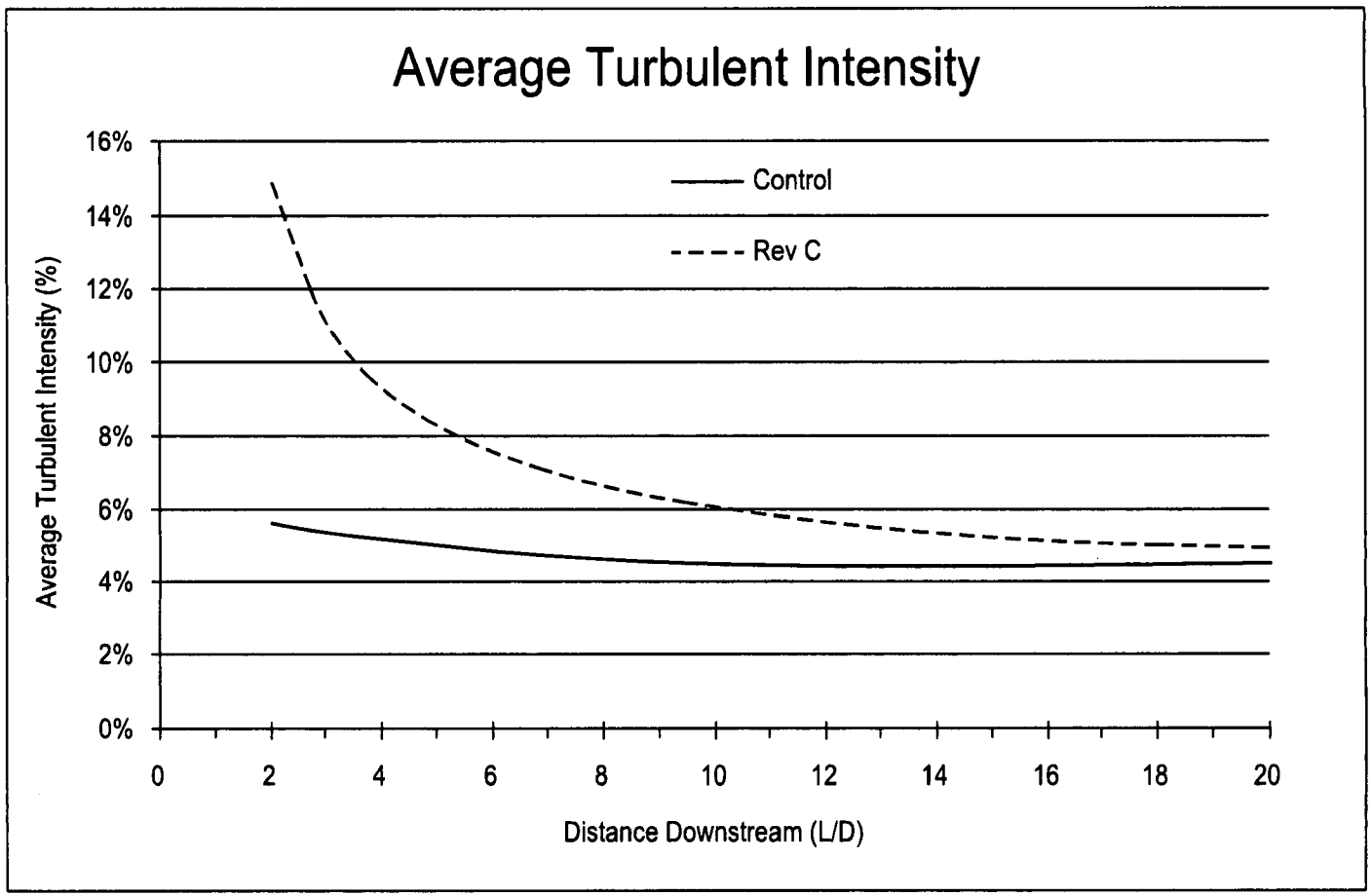
FIG. 9 is a graph of the turbulent intensity for the device of the present invention (Rev C).

Turbulence is measured as turbulent intensity or the ratio of the root mean square of the velocity fluctuations to the mean flow. The decay of turbulent intensity downstream of the flow conditioner remains constant across all flow rates tested and will be constant for all turbulent flow conditions. The turbulent intensity by 10D was 6% with the flow conditioner compared to 5% without the flow conditioner. At 20D, the average turbulent intensities were equal with and without a flow conditioner, although the distributions across the pipe cross section were different because of the different flow patterns. The turbulent intensity with the secondary tabs is very similar to the turbulence without the secondary tabs. A plot of turbulent intensity for the 1000-cfm case is set forth in FIG. 9.

Mixing:

Although mixing was not tested in this case, it is likely that mixing rates are decreased somewhat with the secondary tabs due to the suppression of circulation downstream of the flow conditioner.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In combination with a hollow tubular conduit defining an internal longitudinal passageway wherein said conduit includes an internal wall surface, a flow conditioning device positioned in said conduit and within a fluid stream having a longitudinal flow direction with said passageway, said device including a first stage and a second stage wherein said second stage is positioned immediately downstream of said first stage, said first stage comprising a plurality of primary vane members forming a set thereof, said vanes spaced generally circumferentially equidistantly within said conduit and radially inwardly extending from said conduit internal wall surface towards the center of said conduit, each of said primary vane members including a generally oblong plate of planar extent with a generally straight base edge attached to said internal conduit wall and further including a leading edge upstanding from a base edge forward portion to a peak from which, in turn, a rearwardly downwardly curved trailing edge extends and terminates proximal the rear portion of said base edge, each of said plates including a generally triangularly-shaped cap attached and conforming to said curved trailing edge thereof with the cap apex aligned with said leading edge peak so as to form cap undersurfaces and cap top surfaces and said second stage comprising a plurality of secondary vanes each having a secondary plate member including a base edge surface disposed against the conduit surface at an offset position vis-à-vis the positions of said primary vanes, said secondary plates radially inwardly extending into the fluid stream and, said secondary plates including a flat wing member extending laterally therefrom.

2. The device of claim 1, wherein four primary vane members are provided.

3. The device of claim 1, wherein the leading edge is upwardly rearwardly slanted.

4. The device of claim 1, wherein the longitudinal extent of said primary vanes is approximately one diameter of said conduit.

5. The device of claim 1, wherein said cap undersurfaces directing the fluid flow passing through said conduit against said conduit internal wall surfaces and said cap top surfaces developing trailing vortices in the portion of the fluid flow passing thereover and wherein said trailing vortices contact said secondary vanes so as to eliminate swirl and turbulence caused by such trailing vortices.

6. The device of claim 1, wherein said secondary plate members include an upwardly rearwardly slanted leading edge.

7. The device of claim 1, wherein said secondary plate members include an upper extension extending above said wing member.

* * * * *